US009032995B2

(12) United States Patent
Spiegel

(10) Patent No.: US 9,032,995 B2
(45) Date of Patent: May 19, 2015

(54) LIQUID SUPPLY WITH CIRCULATION VIA THROUGH-PASSING INNER PIPES

(76) Inventor: Herbert Spiegel, Niederwerrn (DE)

( * ) Notice: Subject to any disclaimer, the term of this patent is extended or adjusted under 35 U.S.C. 154(b) by 82 days.

(21) Appl. No.: 13/817,080

(22) PCT Filed: Aug. 16, 2011

(86) PCT No.: PCT/DE2011/001594
§ 371 (c)(1),
(2), (4) Date: Mar. 11, 2013

(87) PCT Pub. No.: WO2012/025095
PCT Pub. Date: Mar. 1, 2012

(65) Prior Publication Data

US 2013/0167956 A1 Jul. 4, 2013

(30) Foreign Application Priority Data

Aug. 16, 2010 (DE) ..... 10 2010 034 455
Jan. 17, 2011 (DE) ..... 10 2011 008 721

(51) Int. Cl.
*E03B 7/04* (2006.01)
*F24D 17/00* (2006.01)
*F17D 1/00* (2006.01)

(52) U.S. Cl.
CPC ..... *F17D 1/00* (2013.01); *F24D 17/0084* (2013.01); *E03B 7/045* (2013.01)

(58) Field of Classification Search
CPC ..... F24D 17/0084; E03B 7/045
USPC ..... 137/563, 565.35, 599.11; 138/113, 114; 237/59, 63; 285/123.1
See application file for complete search history.

(56) References Cited

U.S. PATENT DOCUMENTS

| | | | | | |
|---|---|---|---|---|---|
| 349,202 | A | * | 9/1886 | Bassett | 237/59 |
| 2,031,849 | A | * | 2/1936 | O'Leary | 285/123.4 |
| 2,475,635 | A | * | 7/1949 | Parsons | 138/114 |
| 4,535,934 | A | * | 8/1985 | Rodd | 237/70 |
| 4,886,305 | A | * | 12/1989 | Martin | 138/113 |
| 5,060,861 | A | * | 10/1991 | Holt | 239/124 |
| 5,419,593 | A | * | 5/1995 | Greene et al. | 138/114 |

(Continued)

FOREIGN PATENT DOCUMENTS

| | | | |
|---|---|---|---|
| DE | 3523596 | A1 | 1/1987 |
| DE | 3542374 | A * | 5/1987 |

(Continued)

OTHER PUBLICATIONS

International Search Report (with English translation) for PCT Application No. PCT/DE2011/001594, dated Jan. 11, 2013.

(Continued)

*Primary Examiner* — John Rivell
(74) *Attorney, Agent, or Firm* — Westman, Champlin & Koehler, P.A.

(57) ABSTRACT

The invention relates to a liquid supply system wherein liquid, such as for example, a supply of warm water, circulates. Said system consists of thick outer tubes, the inner chamber of said thick outer tubes allowing a liquid to flow through, a thin inner tube is respectively placed inside the outer tube in which the liquid can flow in the direction counter to that in the inner chamber. In the path of at least one outer tube, a first tube branch is introduced enabling the first inner tube to be withdrawn, and in said first branch, at least one functional component, such as a shut-off valve, is introduced into the inner tube and guided to a second tube branch in the path of an outer tube and extends further through said tube branch and then into the inner chamber of the latter outer tube.

11 Claims, 2 Drawing Sheets

(56) References Cited

U.S. PATENT DOCUMENTS

Figure 1:
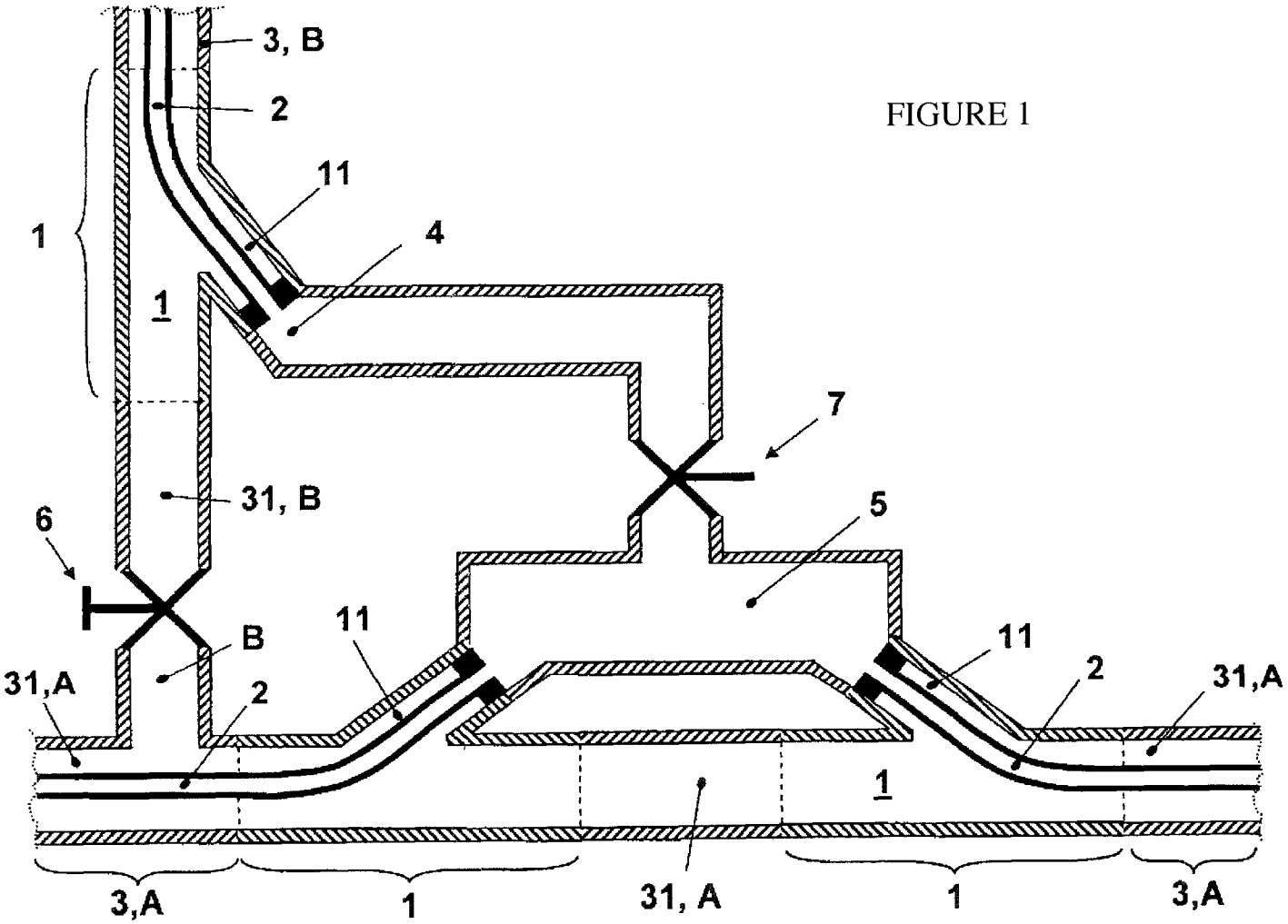

| | | | | |
|---|---|---|---|---|
| 5,427,474 | A * | 6/1995 | Silvers | 285/123.1 |
| 6,082,781 | A * | 7/2000 | Spiegel et al. | 285/133.11 |
| 6,565,127 | B2 * | 5/2003 | Webb et al. | 285/123.1 |
| 6,705,344 | B2 * | 3/2004 | Poirier | 137/563 |
| 2010/0193058 | A1 * | 8/2010 | Blumenthal | 137/625 |

FOREIGN PATENT DOCUMENTS

| | | | |
|---|---|---|---|
| DE | 3926202 | A1 | 3/1990 |
| DE | 198 49 362 | C2 | 10/2002 |
| GB | 2334568 | A | 8/1999 |
| GB | 2457918 | A * | 9/2009 |
| WO | WO 2004070279 | A2 * | 8/2004 |
| WO | 2010083644 | A1 | 7/2010 |

OTHER PUBLICATIONS

International Report on Patentability and Written Opinion for PCT Application No. PCT/DE2011/001594, dated Apr. 16, 2013, 7 pages.

* cited by examiner

LIQUID SUPPLY WITH CIRCULATION VIA THROUGH-PASSING INNER PIPES

This Application is a Section 371 National Stage Application of International Application No. PCT/DE2011/001594, filed Aug. 16, 2011 and published as WO 2012/025095 A2 on Mar. 1, 2012, in German, the contents of which are hereby incorporated by reference in their entirety.

The invention relates to a liquid supply with circulation, for example a hot water supply, comprising thick outer pipes, in the inner space of which a liquid can flow and a thin inner pipe is installed in each case, in which the liquid can flow in the opposite direction to that in which it can flow in the inner space.

For hot water supplies in buildings and the lines of temperature-controlled liquids in chemical production plants and other systems, in which a relatively large distance between the source of the temperature-controlled liquid and the place of consumption has to be overcome, it is known not only to install a single line from the source to the place of consumption, but two lines, which are led in parallel and, in the vicinity of the source and in the vicinity of the place of consumption, are consolidated again to form a common line in each case. In these two, parallel lines, a pump or the different specific weight of the differently temperature-controlled liquids in the two line sections ensures the "circulation" of the water, that is to say a continuous circuit, in which the liquid flows away in one line and back again in the parallel line.

In contrast to a single line, in which the liquid is stationary and is only set into motion at the beginning of the removal, there is consequently always a desirably temperature-controlled amount of liquid in the vicinity of the point of removal.

In the application example of a household water supply, it is achieved for example by means of circulation, for example, that there are no relatively long pipe sections with stationary water that is only slightly heated and thereby highly beneficial living conditions are created for undesirable bacterial, for example *legionella*, so that, at the beginning of removal from a tap point, water can be contaminated by the numerous grown microorganisms.

Since in the current state of microbiological, bacteria strains are observed that are very much more resilient, or even resistant, to currently widespread antibiotics, uniform heating of the already contained water is of increasing importance.

With increasing energy costs, "semi-heated" water should not be allowed to flow unused back into the wastewater system, because the thermal energy stored therein is lost. This is remedied by circulation.

A further important reason for circulation is a globally increasing scarcity of drinking water, for which reason the squandering of inadequately heated quantities of water is becoming ever more expensive.

Since two parallel lines, with their additional need for space and insulation, as well as components for the second line, are relatively expensive, it is known in the prior art two guide two parallel pipes coaxially.

Thus, DE 39 26 202 A1 describes and outer pipe of relatively large diameter, in the interior space of which an interior pipe of comparatively small diameter is led coaxially. Disclosed and angle pieces and T-shaped and Y-shaped branches which contain the plug sockets for an outer pipe and an inner pipe in each case. A constant spacing between the outer pipe and inner pipe throughout is thereby achieved.

However, the extremely high effort for these connecting pieces is disadvantageous. Since the inner connecting sockets cannot be introduced as a separate part into the outer connecting sockets, either a two-shell construction of the outer connecting socket is necessary, or an extremely complicated casting mould. It nevertheless remains questionable whether an at least satisfactory sealing effect can be obtained.

German patent DE 198 49 362 C2 presents, for hot-water supply, in particular of buildings, coaxially led pipes and angle-pieces and T-branches specially adapted for this system. It is also explained in detail what a fitting with a valve for controlling the liquid stream through the inner pipe looks like.

Since a fitting, for example a valve, for an inner pipe must be reachable from outside, in order to be moved from there by means of a handwheel, by means of a rotating motor or by means of another drive, the fitting must have a pipe section that runs through the outer pipe, transversely to the longitudinal direction thereof, into the inner pipe, and is there connected to the inner pipe. The shaft for actuating the fitting in the inner pipe runs through this transverse pipe.

Even this short described makes very clear that such fittings must be specially tailored to the respective pipe system and therefore require a high design outlay. In addition to the disadvantage of these complicated design, they must also bear the economic disadvantage of relatively small unit quantities, so that the system is made more expensive due to this "scaling effect,"

Because of the high constructional and logistical effort for the production, provision and installation of double-shell branches and the outlay for the integration of valves and other functional modules, such systems have not been able to prevail on a wide front in the prior art.

Rather, water pipes that run one inside the other for circulation have been principally restricted to straight-running pipe sections in practice.

At branches or for fittings, a changeover is then made from coaxial pipes to parallel pipes or circulation is dispensed with. The advantages of coaxially running pipes with respect to lower installation costs and lower outlay for the insulation and lower space requirement for the installation have therefore in the past usually been restricted to a very small circumference.

The systems mentioned here, with consistently double-walled pipe guidance, even at angles, branches and fittings, are so expensive, due to the high outlay for these special parts, that they cancel out the principle advantage of the "pipe within a pipe."

Against this background, it is the object of the invention to construct even relatively large systems for supplying temperature-controlled liquids such that, in the greatest portions of the pipe sections, the two pipes of the circulation are led one inside the other, but nevertheless, at angles, branches and fittings, not elaborate special parts but widespread standard components can be used.

As a solution, the invention teaches that, in the route of an outer pipe, at least one first pipe branch is inserted, through which the inner pipe is led outwards and, here, at least one functional module, such as, for example, a shut-off valve, is inserted into the inner pipe, and the inner pipe is led in the route of the outer pipe and through this pipe branch and then runs further in the interior space of the outer pipe.

It is thus a key idea of the invention, to dispense with the coaxial running of the two pipes at "critical" points of the pipe guidance, that is to say at branches, distributors and fittings, to dispense with allowing the two pipes to run coaxially so that arbitrary standardized components can be used in these regions, As a principle different from the prior art, however, directly "downstream" of these points, the inner pipes are immediately led back into the outer pipe through a further pipe branch. As a result, in these regions, the complicated special parts that were necessary in the prior art, are avoided and the additional outlay compared to single-shell pipes is reduced to a single special part, namely the pipe branch.

A further advantage that is obtained thereby is that the assembly also requires only moderate special outlays and no commitment to particular types of connection. Instead, besides screw connections, plug connections, welded connections or connections produced by section-wise bending, such as so-called "press fittings" are also used. Adhesive and welded connections are also possible. if a workspace around the connection zone is required to produce them, it can be created comparatively easily.

The insulations to be mounted on these pipes and these connections are known and proven in numerous variants as standard components.

A very decisive advantage of the idea according to the invention is that arbitrary functional modules, such as, for example, balancing valves for reducing the operating pressure at riser lines and at secondary lines can be incorporated into the system without considerable additional problems. In this manner, even complex automatically controlled valves and the pressure sensors and/or temperature sensors that are necessary for this purpose can be integrated.

For producing a T-connection, it is sufficient, in the system according to the invention, if a pipe branch in each case is inserted into all three outer pipes that lead to the connection point. The inner pipes of each pipe branch can be led outwards through these pipe branches shortly "upstream" of the branch and, can be connected to one another outside the outer pipes by means of a conventional T-piece that is widely known in the prior art. Likewise the three outer pipes running to the T-connection are connected to one another in a second T-piece. In this manner, even line junctions or complicated line distributors can be produced relatively quickly and easily using the standard components known for this purpose.

A further advantage of the basic concept of the invention is that it is also possible to retrofit existing systems with a circulation at relatively limited cost. To this end it is only necessary to cut open the pipe section provided with a circulation at the beginning and at the end, and to insert a pipe branch here. An inner pipe is then introduced through the first pipe branch, pushed through the pipe and led outwards again at the second pipe branch. By this means, the formerly single-shell pipe becomes the outer pipe of a double-shell pipe system.

If functional modules are inserted into an outer pipe, they are removed from the route of the inner pipe in the same manner as for a bypass. The inner pipe thus runs externally along these functional modules.

Thanks to the separation of the inner pipe and outer pipe in the region of the functional modules, all functional modules that are known or will be introduced in future can be used, such as, for example, branches, junction pieces, outlet valves, adapters, distributors, valves, shut-off organs, meters, pumps, boilers and/or temperature sensors. Sight glasses, filter or small material buffers, such as, for example, ion exchangers, can, in this manner, be installed in a liquid supply according to the invention.

In the case of a variant that is advantageous to lay, in the case of at least one pipe branch, the longitudinal axis of the branching-off pipe socket has an acute angle with respect to the longitudinal axis of the through-running outer pipe. In contrast to a pipe socket branching off at right-angles, the advantage of this orientation is that the radius of curvature of the inner pipe, on its route from the inner space of the outer pipe and through the wall of the outer pipe to the outside, is considerably larger and, thereby, strong turbulence does not form in the region of the curvature even at high flow rates, which is to the benefit of the lifetime of the inner pipe.

This "angled" orientation of the pipe socket is furthermore also advantageous for the assembly of the inner pipe if the inner pipe consists of a material that is flexible, at least during laying. Then, the inner pipe can be unwound, for example as meter goods, from a large reel and inserted into the pipe socket. As soon as it meets the wall lying opposite the pipe socket, then, due to the acute angle of the pipe socket with respect to the longitudinal axis of the outer pipe, the direction in which the inner pipe moves further is clearly determined. It then slides along the wall. With further pushing, the front region of the inner pipe curves and penetrates into the outer pipe.

This curvature is restored again with continued pushing. A resilient inner pipe—e.g. of a plastic—automatically assumes a straight shape. A material that is only elastic but hardly resilient, such as a copper pipe, is only straightened back into an approximately straight form by contact with the inner walls of the outer pipe.

In this manner, the inner pipe is continually pushed through the outer pipe until it reaches the next pipe branch, and is therefore brought outwards again through the pipe socket.

In the next step, both ends of the inserted inner pipe must be sealingly connected to the two pipe sockets. For this purpose, for example, a ring can be used, which is pushed in the intermediate space between the inner pipe and the inner wall of the pipe socket. If this ring is formed conically in cross-section, it can then be pressed, by means of a union nut on the pipe socket, into the intermediate space between the inner pipe and the inner wall of the pipe socket, and in this way a seal against the liquid can be effected. Of course, other methods for sealing a pipe end in a flange can be applied to connect the inner pipe to the pipe socket.

As already mentioned, a decisive advantage of the liquid supply system according to the invention is that the predominant portion of its pipe length can be executed with pipes led one inside the other. For example, for supplying a building with bathtub water, the vertical riser lines as well as the horizontal secondary lines can both be equipped in this manner. And the main line, which supplies the individual riser lines, can also be provided with an inner pipe.

Here, an interesting variant is that, close to the branch of the outer pipe of a riser line of the outer pipe of a main line or close to the branches of the outer pipe of a secondary line from the outer pipe of a riser line, the inner pipes are in each case led outwards by means of pipe sockets and are connected together by means of a branch in each case for the inner pipes and a balancing valve for pressure control. By this means, appropriate water pressures can be regulated in all sections of the liquid supply.

As repeatedly mentioned, it is a decisive advantage that the valves can be selected without taking into account the special requirements of the line system, so that any connection system can be inserted. If the connection present on the pipe socket of the pipe branch does not fit the connection of the valve—or a different functional module to be installed here—corresponding adapters can be inserted with reasonable outlay.

By means of this flexibility of the system according to the invention, it is possible, for example, to install outlet valves for draining the outer pipes and/or the inner pipes at the points appropriate for this.

A further decisive advantage is that the same functional modules can be used both for the inner pipes and for the outer pipes. As mentioned above, an arbitrary functional module can also be used in the route of an outer pipe. In this case the inner pipe is led past the functional module in a bypass, that is to say a pipe branch in each case is inserted upstream and downstream of the functional module, through which the inner pipe is led out, is screwed to the next section of the inner pipe in the outer region, and from there led back into the inner space of the next section of the outer pipe.

Figure 2:
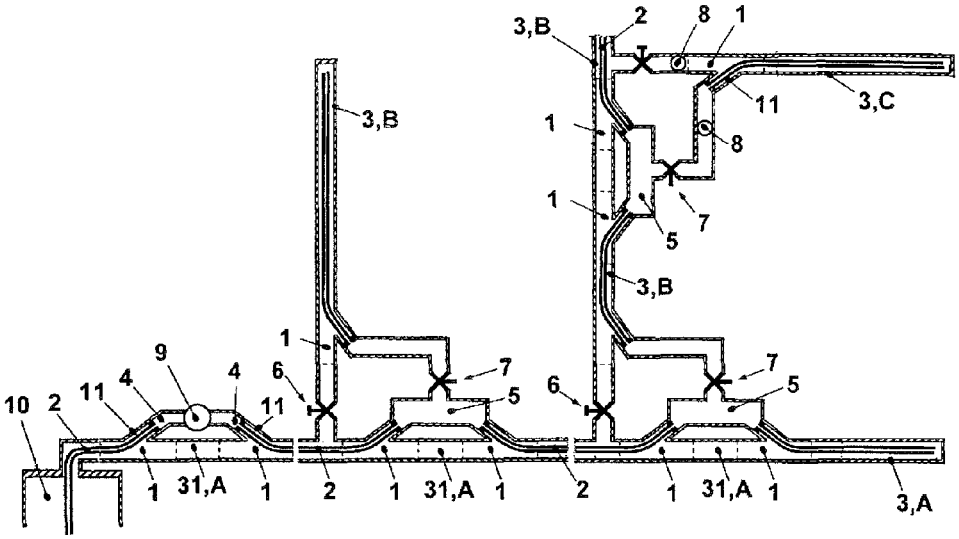

Further details and features of the invention are explained below in greater detail with reference to an example. This is not intended to restrict the invention, but only to explain it, In diagrammatic view, FIG. 1 shows a section through a branch with two valves FIG. 2 shows a section through a supply comprising a main line, riser line and secondary line FIG. 1 shows a diagrammatic cross-section through a T-shaped branch, which is equipped with a shut-off valve 6 in the route of the outer pipe 3 of the branching riser line B as well as with a balance valve 7 in the route of the associated, branching inner pipe 2.

Here, the diagrammatic representation focuses predominantly on the relationships between the inner spaces 31 of the outer pipes 3 and the route of the inner pipes 2. The connections between the pipe branches 1 and the connecting outer pipes 3 as well as the connections between the pipe socket 11 and the functional modules connecting thereto, such as, for example, a distributor 5, are therefore not shown in FIG. 1. FIG. 1, as well as FIG. 2, is restricted by the fact that the limits between the components are only indicated by a different hatching of the cross-section of the wall regions of the pipe branches 1, the wall regions of the outer pipes 3 and of the functional modules.

The section through the inner pipes 2 is also greatly simplified. The sectional surfaces of the walls of the inner pipes 2 are only represented by a relatively thick black line. The screw joints or otherwise embodied connections of the ends of the inner pipes 2 in the pipe socket 11 are only schematically indicated by black rectangles. Likewise, the representation of the valves 6 and 7, for the sake of clarity, instead of a realistic, principle cross-section, is actually reduced to the symbol of two crossed lines, which is actually only conventional for plans.

To make the spatial relationships easier to understand, the cross-sections of the pipes and all functional modules are chosen to be relatively large.

By means of these simplifications, the purpose of a T-connection is relatively easy to understand in FIG. 1.

On the lower edge of FIG. 1, a main line A, which runs through horizontally, can be recognized. In this main line A, a T-piece is installed at the left-hand side as branch for the riser line B and the shut-off valve 6 is inserted into the riser line B.

FIG. 1 shows how, on such a T-connection, according to the invention, the inner pipe 2 is led "past" a circulation line. The uniform route of the circulation line, consisting of inner pipes 2, is interrupted in order to branch off an inner pipe 2 for the riser line B therefrom.

For this purpose, two pipe branches 1 are inserted into the outer pipes 3 of the main line A. Since the pipe sockets 11 in each case of the two pipe branches 1 are oriented at an acute angle to the longitudinal axis of the pipe branch 1, the two pipe branches 1 are inserted in opposite directions and, at a distance from one another, into the outer pipes 3 of the main line A.

The two pipe sockets 11 of the pipe branches 1 are connected to a distributor 5, which in the embodiment shown here is a T-piece, from which a pipe piece branches upward. For this distributor 5, as well as for all other elements, the concrete connections to the adjacent pipes or functional modules are not shown in FIG. 1, However, it is clear that the liquid flows out of the left-hand inner pipe 2 into the inner space of the distributor 5, and there is distributed to the pipe piece that continues upwards and to the right-hand inner pipe 2.

From the upwardly running pipe piece, the liquid flows through an open balancing valve 7 and through a further, one-shell pipeline to a third pipe branch 1. Here, it enters into a third instance of an inner pipe 2, which extends vertically upwards in the continued route of the riser line B.

In FIG. 1, it is not shown how the pipes and other modules are provided with thermal insulation, since that is known in the prior art.

In FIG. 2, the branch from the main line A, which is shown in FIG. 1, is included twice, specifically at the bottom right and at the bottom centre. By this means, it is explained how, into a horizontal main line A, which is provided with a through-passing inner pipe 2, upwardly branching riser lines B are connected, and, in the process, a shut-off valve 6 in each case is inserted into the outer pipe 3, and a balancing valve 7 is inserted into the inner pipe 2.

These two branches are completed with further characteristic examples to form a simple hot-water supply system of a building with a plurality of stories. From the right-hand riser line B, a secondary line C branches off at the top right. In FIG. 2, it can clearly be seen that this branch is constructed according the same pattern as the branches of the riser lines B from the main line A, that is to say the inner pipes 2 are led past the T-shaped branch of the outer pipes 3 and outward, where they are branched in a separate distributor 5. It can readily be seen how, out of the distributor 5, the inner pipe for the secondary line C is led through the pipe socket 11 of a further pipe branch 1 into the inner space 31 of the outer pipes 3 of the secondary line C.

In FIG. 2, at the branch of the secondary line C out of the riser line B, a meter 8 in each case is inserted into the outer pipe 3 and into the route of the inner pipe 2. These two meters are symbolized by a circle within the pipe. The difference between the water quantities that have run through these two meters then results in the water quantity actually consumed from the secondary line C.

In FIG. 2, it is not shown how liquid consumers such as wash basins, bathtubs, toilets, dishwashers and others are connected to the secondary line C and to that end of the main line A that is shown at the bottom right.

It can be readily seen in FIG. 2 how the feeding of the temperature-controlled liquid is fed into the liquid supply according to the invention. The boiler 10 is shown at the bottom left, in which the liquid—which is not shown here—is temperature controlled. A double-shell pipeline is connected to the boiler 10. In this embodiment, the inner pipe 2 is led into the depth of the boiler 10, where it has continuous contact with the liquid.

At the left in FIG. 2, for inserting a pump 9 at the beginning of the main line A, the inner pipe 2 is led outwards via two pipe branches 1, and, via their two pipe sockets 11 and via adapter 4—which is not shown in FIG. 2—is connected to a pump 9.

In FIG. 2, it can be readily understood how the pump 9 sucks liquid out of the boiler 10, via the inner pipe 2, which is shown at the far left, and feeds it via a further inner pipe 2 into the liquid supply.

The invention claimed is:

1. Liquid supply with a circulation, for example a hot water supply, comprising thick outer pipes, in the inner space of which a liquid can flow and a thin inner pipe is installed in each case, in which the liquid can flow in the opposite direction to that in which it can flow in the inner space, and having a T-connection of outer pipes and inner pipes, characterized in that for producing a T-connection a pipe branch is inserted in each case into all three outer pipes that lead to the connection point, and the outer pipes running to the T-connection are connected to one another in a second T-piece, whereby at the place where in the course of one of the outer pipes one of the braches is inserted, through which one of the inner pipes is led outwards, here, at least one balancing valve is inserted into the inner pipe.

2. Liquid supply according to claim 1, characterzied in that an inner pipe through a pipe branch, can be led in a first outer pipe, out of the inner space thereof and through a further pipe branch, can be led in a second outer pipe, into the inner space thereof.

3. Liquid supply according to claim 1, characterized in that a first outer pipe can be subsequently cut open at an arbitrary, mechanically accessible point and can be sealed again by the insertion of a first pipe branch and a second outer pipe can also be subsequently cut open at an arbitrary, mechanically accessible point and can be sealed again by the insertion of a first pipe branch and through the two pipe branches, an inner pipe can be led out of the inner space of the first outer pipe and led back into the inner space of the second outer pipe.

4. Liquid supply according to claim 1, characterized in that, a functional module is inserted in a region of an outer pipe, which lies between two pipe branches and which is free of an inner pipe.

5. Liquid supply according to claim 4, characterized in that, with the same connection pieces, functional modules can optionally be inserted into the outer pipe or can be connected to an inner pipe.

6. Liquid supply according to claim 4, characterized in that the functional module is pipe coupling and/or a branch and/or a junction and/or an outlet valve and/or an adapter and/or a distributor and/or a shut-off valve and/or a shut-off and/or a meter and/or a pump and/or a boiler and/or a temperature sensor.

7. Liquid supply according to claim 1, characterized in that, in the case of at least one pipe branch, the longitudinal axis of the branching pipe socket assumes an acute angle with the longitudinal axis of the through-running outer pipe.

8. Liquid supply according to claim 7, characterized in that the inner pipe is, at least during laying, flexible, and, by means of forces that are applied outside the outer pipe, approximately in the longitudinal direction, onto the inner pipe, can be pushed through a pipe socket, which is oriented at an acute angle, into the inner space of an outer pipe and therein can be pushed further.

9. Liquid supply according to claim 1, characterized in that it contains sections with different directions, which can run, for example as a riser line (B) in a vertical direction or as a secondary line (C) in a horizontal direction.

10. Liquid supply according to claim 1, characterized in that, close to the branches of the outer pipe of a riser line (B), from the outer pipe of a main line (A) or close to the branches of the outer pipe of a secondary line (C) from the outer pipe of a riser line (B), the inner pipes in each case are led through pipe nozzles outward and are connected to one another via, in each case, a branch for the inner pipes and a balancing valve for pressure regulation.

11. Liquid supply according to claim 1, characterized in that outlet valves for draining the outer pipes and/or the inner pipes are installed.

* * * * *